US006553578B2

(12) United States Patent
Phillips

(10) Patent No.: US 6,553,578 B2
(45) Date of Patent: Apr. 29, 2003

(54) PROTECTIVE GARMENT

(76) Inventor: Anthony Grey Phillips, 539 N. Main St., Suffield, CT (US) 06078

( * ) Notice: Subject to any disclaimer, the term of this patent is extended or adjusted under 35 U.S.C. 154(b) by 0 days.

(21) Appl. No.: 09/973,536

(22) Filed: Oct. 9, 2001

(65) Prior Publication Data

US 2002/0073480 A1 Jun. 20, 2002

Related U.S. Application Data

(62) Division of application No. 09/775,902, filed on Feb. 2, 2001.

(60) Provisional application No. 60/179,790, filed on Feb. 2, 2000.

(51) Int. Cl.[7] ..... A41D 13/00

(52) U.S. Cl. ..... 2/242

(58) Field of Search ..... 2/24, 44, 46, 59, 2/16, 62, 455, 242, 22, 311, 911; 128/99.1, 100.1, 876, 878, 881, 882; 602/23, 26, 1, 41, 62, 19; 119/856

(56) References Cited

U.S. PATENT DOCUMENTS 5,137,508 A * 8/1992 Engman ..... 602/79
5,173,967 A * 12/1992 Carter ..... 2/242
6,105,163 A * 8/2000 Edmiston ..... 2/22
6,463,594 B2 * 10/2002 Phillips ..... 2/242
6,490,736 B2 * 12/2002 Phillips ..... 2/242

* cited by examiner

*Primary Examiner*—Gloria M. Hale
*Assistant Examiner*—Tejash Patel

(57) ABSTRACT

In a protective garment, a facing and backing layer are positioned adjacent one another with a layer of insulating material interposed therebetween. The layers are sewn together in a quilted pattern defined by lines of stitching, portions of which include closely spaced patterns of reinforcing stitches. The facing and backing layers as well as the insulating layer of material are sized to extend around and partway along the limb of a wearer with fasteners extending along opposed lateral edges to releasably attach the garment to the wearer's limb.

6 Claims, 2 Drawing Sheets

Fig. 1
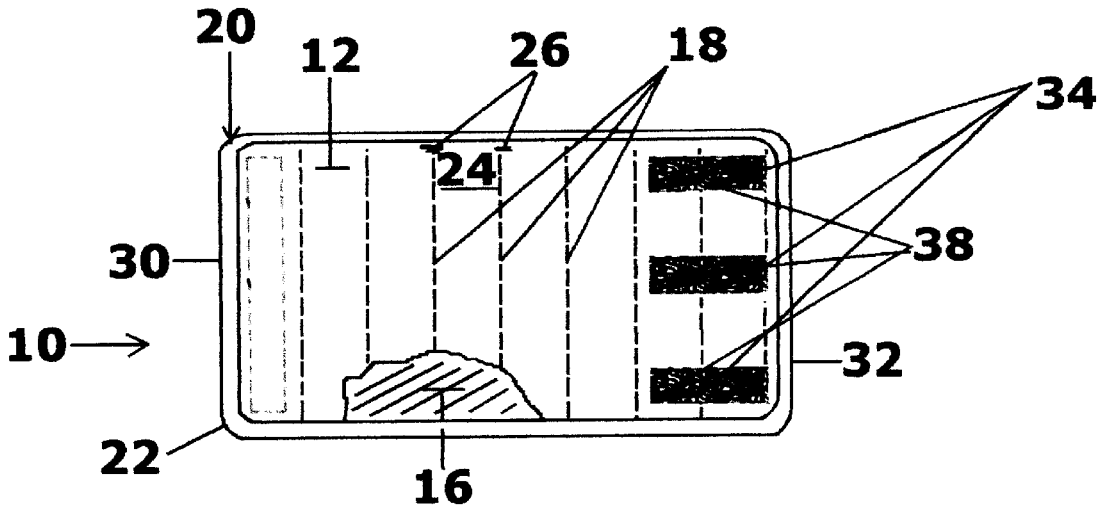
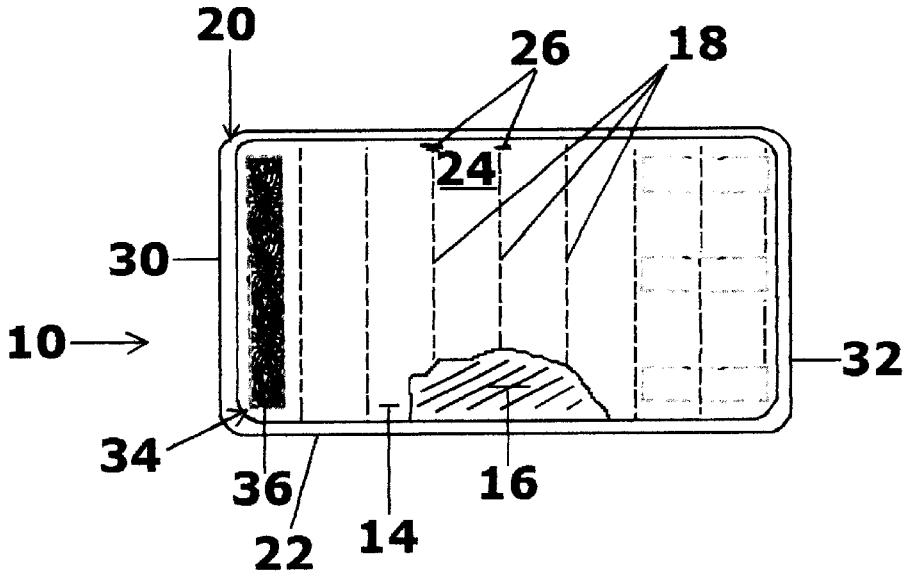
Fig. 2

PROTECTIVE GARMENT

CROSS REFERENCE TO RELATED APPLICATIONS

This divisional application claims priority to U.S. non-provisional patent application Ser. No. 09/775,902, filed Feb. 2, 2001, which is herein incorporated by reference.

Application Ser. No. 09/775,902, filed Feb. 2, 2001, claims priority to U.S. provisional patent application Ser. No. 60/179,790, filed Feb. 2, 2000, which is herein incorporated by reference.

FIELD OF THE INVENTION

This invention relates generally to protective garments, and is more specifically directed to garments for selectively protecting portions of a person's body from overexposure to the elements.

BACKGROUND OF THE INVENTION

The use of garments to protect against inclement weather is well known. For example, outdoorsmen, and other people subjected to the elements, have used various protective garments to insulate themselves against the adverse effects of cold and wetness. Motorcyclists and snowmobilers typically employ multiple layers of clothing to combat the adverse effects of exposure. However, additional layers of clothing can become heavy, bulky, slippery, and/or cumbersome, especially if they become soaked or coated with water or ice. Such problems are undesirable since the mobility of the wearer is impaired, potentially preventing the safe operation of the motorcycle or snowmobile.

A problem associated with wearing bulky garments or several layers is that sometimes additional protection is only needed at localized body areas which are more susceptible to, or more exposed to, cold or wet weather conditions. For example, when riding a motorcycle or snowmobile, extra protection in the front or back of the thighs, or over the knee area, is desirable. At other times, extra protection is only desired towards the ends of the limbs (e.g. calves, forearms) which tend to cool quicker than the trunk of the body in an exposed environment. The bottom portions of the legs are especially susceptible to temperature extremes, as they are often closer to accumulated precipitation.

Tubes of fabric having annular and/or other strands of elastic material, commonly referred to as legwarmers, are a known garment for protecting the lower legs against the cold. However, legwarmers are generally not designed with material that significantly protects against wetness. Additionally, the limited elastic quality of legwarmers generally constrains the amount of clothing and/or thickness of the limb that a legwarmer can be pulled or fitted over without constraining blood flow or unduly damaging the legwarmer. Legwarmers also tend to lose a significant amount of elasticity during repeated/extended usage, resulting in an inability to maintain proper placement, uncomfortable bunching, and/or limited ability to retain body heat.

Based on the foregoing, it is the general object of the present invention to overcome the problems and drawbacks of prior art protective garments.

SUMMARY OF THE INVENTION

In one aspect, the present invention is directed to a protective garment which includes coupled facing and backing layers of material sized to extend around and partway along the limb of a wearer. The facing and backing layers of material are quilted via one or more lines of stitching. Fastening means are used to join opposed edge portions of the facing and backing after the protective garment is wrapped around a limb of the wearer.

In the first preferred embodiment of the present invention, a layer of insulating material is interposed between said facing and backing layers of material, and the stitching includes quilting thread sewn along the facing and backing to create a channeled pattern. The layer of insulating material is usually composed of material having good insulating quality, such as 10.5 ounce polyester batting. Further, the facing is made of waterproof or water-resistant material such as 200 dernier nylon coated with polyurethane. The backing can be 68 dernier nylon or taffeta. Preferably, the quilting thread is fine enough so as not to create holes in the facing and backing sufficient in size to allow the ready passage of water. Of course, it is to be understood that the present invention contemplates that the facing and backing layers of material, as well as the layer of insulating material, could be made from any number of garment materials. Additionally, manners of stitching other than channel patterns of fine quilting thread can be utilized.

Preferably, the fastening means for joining the opposed edge portions of the garment are strips of hook and loop fastening material affixed, preferably, but not limited to, sewing to the facing and backing layers of material. One strip of hooked fastening material is sewn on the backing layer along one of the opposed edge portions, while three spaced strips of loop fastening material are sewn on the facing layer adjacent to the other opposed edge portion and approximately perpendicular to the strip of hooked fastening material.

The strips of looped fastening material are sized to allow adjustment over a substantial range to accommodate varying limb sizes. The facing and backing layers of material and strips of loop fastener material are sized to allow the typical user to secure two layers of the garment over an area of a limb susceptible to the adverse effect of the elements.

It is to be understood that the present invention contemplates that the number, position, affixing, and, orientation of the strips of hooked and looped fastening material can vary from that of the preferred embodiment. Furthermore, any other number of fastening means can be utilized.

Additionally, a bias can be sewn around the periphery of the garment. The bias provides a border around the protective garment which helps to prevent foreign objects and water from getting between the facing and backing layers of material.

In a second embodiment of the present invention, the protective garment defines one or more slots extending from one or more of the opposed edge portions of the garment Preferably, one approximately U-shaped slot extends from one of the opposed edge portions of the protective garment, thereby defining two-fingerlike projections. During wear, the slot is positioned over the joint, thereby allowing comfortable flexion of the joint.

BRIEF DESCRIPTION OF THE DRAWINGS

FIG. 1 is a front elevational view of a first embodiment of the present invention partially cut away to show a layer of insulating material.

FIG. 2 is a rear elevational view of the right side of a pair of the first embodiment of the present invention partially cut away to show a layer of insulating material.

DETAILED DESCRIPTION OF THE PREFERRED EMBODIMENT

Figure 3:
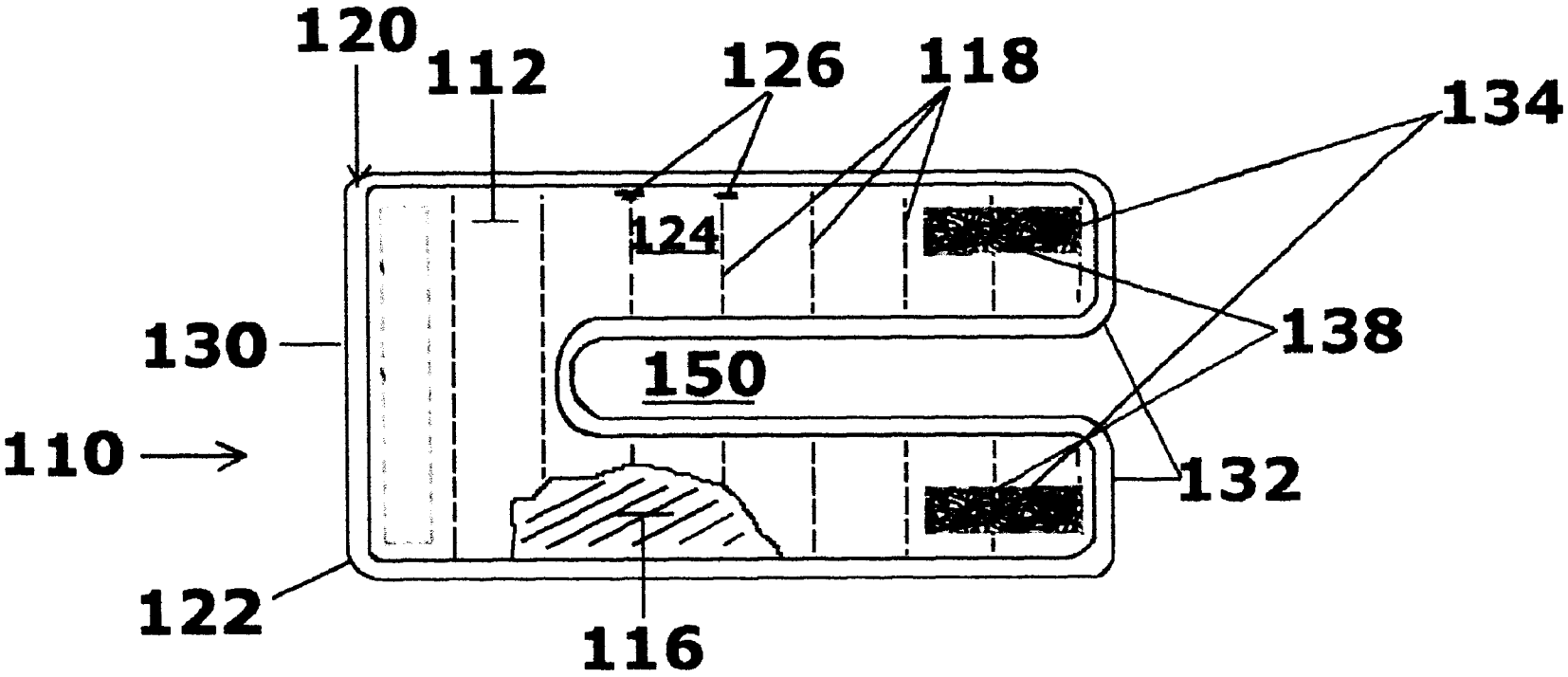
FIG. 3 is a front elevational view of a second embodiment of the present invention partially cut away to show a layer of insulating material.

As shown in FIGS. 1 and 2, a protective garment generally designated by the reference number 10 includes a facing layer of material 12 and a backing layer of material 14. The facing and back layers of material 12 and 14, respectively, are approximately the same size and shape and include a layer of insulating material 16 interposed between them. In the illustrated embodiment, the facing, backing and insulating layers 12, 14, and 16, respectively, are sewn together and include lines of stitch 18 which cause the protective garment 10 to become quilted. Preferably, the lines of stitch 18 are formed using quilting thread; however, the invention is not limited in this regard as other types of material known to those skilled in the pertinent art to which the invention pertains can be substituted for the quilting thread without departing from the broader aspects of the present invention.

In the illustrated embodiment, the protective garment 10 defines an outer periphery 20 covered by a bias/binder 22. In addition, the lines of stitching 18 forming the quilting include portions 24 having a pattern of closely spaced reinforcing stitches 26 adapted to prevent the quilting from coming apart during wear.

The protective garment 10 defines opposing sides 30 and 32, adjacent to which are attached fasteners 34 for joining these ends together when the garment is wrapped around the limb of a user. In the illustrated embodiment, these fasteners 34 are in the form of hook and loop fastening material with a strips (two shown) of hooked material 36 extending along one of said opposed edges 30 at an inner surface, and a plurality of strips (three shown) 38 of looped fastening material being attached adjacent to the other of the opposing ends 32 at an outer surface approximately perpendicular to the strip of hooked material. However, the present invention is not limited in this regard as the hooked and looped strips of material 36, 38 can be substituted for one another without departing from the broader aspects of the present invention. Moreover, while hook and loop fasteners are shown and described, the present invention is not limited in this regard as other types of fasteners, such as, but not limited to, buttons or zippers can be employed without departing from the broader aspects of the present invention.

Preferably, the layer of insulating material 16 is made from a 10.5 ounce polyester batting material with the facing layer of material 12 being 200 denier nylon coated with polyurethane and the backing layer material 14 being 68 denier nylon. However, the invention is not limited in this regard as other weights of nylon or other material such as, but not limited to, taffeta, as well as any number of water-resistant, water-proof, or water-repellant coatings other than polyurethane, can be substituted without departing from the broader aspects of the present invention. In addition, the protective garment 10 is shown in FIGS. 1 and 2 as being sized to extend partway up a user's limb, for example, slightly above or below the knee or elbow of the user. However, the protective garment can also extend approximately the full length of the user's limb to provide additional protection, if necessary. During use of the protective garment 10, a wearer would wrap the garment around his or her limb, attaching the opposing edges with the hook and loop fasteners. The plurality of strips extending along one of the opposed edges 30, 32 allows for adjustment of the garment to accommodate larger or smaller limbs.

FIG. 3 shows another embodiment of the present invention generally designated by the reference number 110. The protective garment 110 is similar in many respects to the garment 10 described hereinabove. Accordingly, like elements will be given like reference numbers preceded by the number 1. The garment 110 differs from the garment 10 in that a slot 150 extends inwardly from one of the opposed edges of the garment. In the illustrated embodiment, the slot is shown as being approximately U-shaped; however, the invention is not limited in this regard as other shaped slots such as rectangular, triangular, or hourglass may be substituted without departing from the broader aspects of the present invention. The slot 150 is designed to be positioned over a joint such as the elbow or knee of the wearer, thereby preventing bunching of the garment behind the joint causing discomfort to the wearer. While the present invention has been shown and described as being fabricated from layers of nylon and insulating material, the invention is not limited in this regard as other materials such as leather, which would require no layering, could be substituted without departing from the broader aspects of the present invention.

While preferred embodiments have been shown and described, various modifications and substitutions may be made without departing from the spirit and scope of the invention. Accordingly, it is to be understood that the present invention has been described by way of example, and not by limitation.

What is claimed is:

1. A protective garment worn about an appendage of a wearer comprising:

rectangular facing and backing planar layers being coupled to one another and sized to extend around and partway along the appendage, with the coupled layers defining opposed free edges;

a layer of insulating material is interposed between the planar layers that include a quilted pattern of closely spaced lines of stitching;

a reinforced stitching is sewn over at least part of one of the lines of stitching;

a stitched binding is sewn along an outer periphery of the garment; and fastening means for releasably joining the opposed free edges, after the garment is wrapped around the appendage;

wherein first and second hook and loop fasteners include at least one first and second strip of material having hook and loop material thereon, that are substantially perpendicular to one another, with the first strip secured to one of the opposed edge at an inner surface while the second strip is adjacent to the other of the opposed free edges at an outer surface.

2. The protective garment of claim 1, wherein at least one line of the stitching includes a quilting thread.

3. The protective garment of claim 1, wherein the backing layer is made of taffeta.

4. The protective garment of claim 1, wherein the facing layer is made of nylon.

5. The protective garment of claim 4, wherein the nylon is coated with polyurethane.

6. The protective garment of claim 1, wherein the insulating material is polyester batting.

* * * * *